US011222741B1

(12) United States Patent
Xu et al.

(10) Patent No.: US 11,222,741 B1
(45) Date of Patent: Jan. 11, 2022

(54) MAGNETIC UNDULATOR SHIM

(71) Applicant: United States Department of Energy, Washington, DC (US)

(72) Inventors: Joseph Z. Xu, Naperville, IL (US); Isaac Vasserman, Darien, IL (US)

(73) Assignee: U.S. Department of Energy, Washington, DC (US)

( * ) Notice: Subject to any disclaimer, the term of this patent is extended or adjusted under 35 U.S.C. 154(b) by 0 days.

(21) Appl. No.: 17/114,951

(22) Filed: Dec. 8, 2020

(51) Int. Cl.
*H01F 7/02* (2006.01)

(52) U.S. Cl.
CPC ..... *H01F 7/021* (2013.01)

(58) Field of Classification Search
CPC ..... H01F 7/021
See application file for complete search history.

(56) References Cited

FOREIGN PATENT DOCUMENTS

JP 06188096 A * 7/1994

* cited by examiner

*Primary Examiner* — Mohamad A Musleh
(74) *Attorney, Agent, or Firm* — Felisa L. Lelsinger; Michael J. Dobbs; Brian J. Lally

(57) ABSTRACT

A magnetic undulator shim having three interconnected sections arranged one after the other in a direction substantially parallel to the beam axis. The first section is adapted to magnetically engage a magnet having a horizontal surface and configured to extend partially onto the horizontal surface of the magnet. The magnet is adjacent to a pole and the magnet and the pole form a boundary. The second third sections are interconnected to form a shape. The shape corresponds to the boundary. The third section is adapted to magnetically engage a surface of the pole.

10 Claims, 5 Drawing Sheets

MAGNETIC UNDULATOR SHIM

GOVERNMENT INTERESTS

The United States Government has rights in this invention pursuant to Contract No. DE-AC02-06CH11357 between the U.S. Department of Energy (DOE) and UChicago Argonne, LLC.

FIELD OF THE INVENTION

The present invention relates generally to undulators, and more particularly, relates to a magnetic undulator shim used for tuning any compact hybrid permanent magnet.

BACKGROUND OF THE INVENTION

Undulators are also known as wigglers and insertion devices. The majority of synchrotron radiation sources, including free electron lasers, utilize insertion devices with a vertically oriented magnetic field that must be adjusted and tuned before use. Modern undulators, though machining of the pieces is more precise than ever before, still require tuning prior to use. An undulator can have the mechanical alignment of the magnetic poles to be machined, assembled, and fine-tuned to within 10 microns. The state of the art currently aligns undulators down to approximately 3 microns (0.003 mm). The errors that subsist after the mechanical alignment of the undulator are mainly caused by the local magnetic moment imperfections of the magnets. Therefore, even after mechanical alignment of the magnetic poles, the magnetic performance of undulators are still substantially out of the required specifications for alignment and further tuning must take place.

Traditional magnetic surface shimming techniques developed 30 years ago are still used today. These tuning techniques range from using a shim, which presented problems that had to be overcome. The prior art shim was magnetically unstable at the smallest undulator gap settings, or when the magnetic field was at its strongest. The prior art shim would flip up into the direction of the electron beam and stand on the surfaces of the poles. Once flipped up, it would interfere with the vacuum chamber surrounding the electron beam, even potentially puncturing the thin walls of the chambers. If the prior art shim flipped up or damages the vacuum chamber, the facility would be shut down for weeks at a time to fix and recalibrate the machine. Initially, to solve the flipping problem, the shim was glued to the surface of the magnet after tuning. However, even the best glues that can be used are damaged by radiation produced within the undulator, eventually ending with the same result of loose shims with flipping problems.

The prior art shim was inconvenient and imprecise to use and so undulators evolved by designing and machining the poles and magnets to be adjustable height. That is, every single pole and magnet height was designed and machined to be to manually height adjustable and permanently tune the magnetic field of the undulator. That not only significantly increases the costs of fabrication of the device, making manual adjustments to every single magnet and pole, but increases the costs of operation as well. Therefore, there is a need for an efficient, a cost-effective, a magnetically stable, and a mechanically stable way to tune an undulator.

SUMMARY OF THE INVENTION

Embodiments of the invention relate to a magnetic undulator shim for tuning any compact hybrid permanent magnet.

BRIEF DESCRIPTION OF THE DRAWINGS

Embodiments of the present invention are illustrated in the accompanying figures where.

DETAILED DESCRIPTION OF THE INVENTION

The following detailed description provides illustrations for embodiments of the present invention. Each example is provided by way of explanation of the present invention, not in limitation of the present invention. Those skilled in the art will recognize that other embodiments for carrying out or practicing the present invention are also possible. Therefore, it is intended that the present invention covers such modifications and variations as come within the scope of the appended claims and their equivalents.

Figure 1:
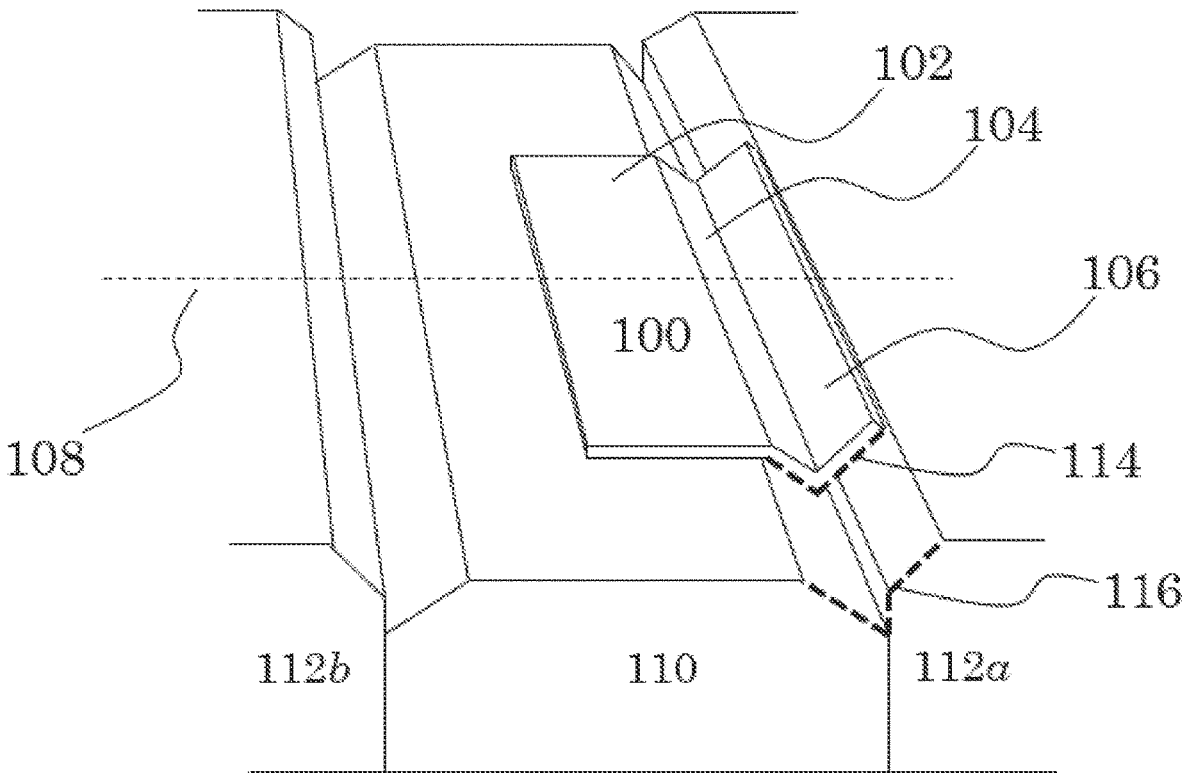
FIG. 1 illustrates a magnetic undulator shim according to an embodiment of the invention.

Referring to FIG. 1, an exemplary magnetic undulator shim 100 for tuning any compact hybrid permanent magnet device according to an embodiment of the present invention is shown. The magnetic undulator shim 100 includes three interconnected sections. The first section 102, the second section 104, and the third section 106 are arranged one after the other in a direction substantially parallel to the beam axis 108. The first section 102 is adapted to magnetically engage a magnet 110 having a horizontal surface and the first section 102 is configured to extend partially onto the horizontal surface of the magnet 110. The magnet 110 is adjacent to at least one pole. As shown in FIG. 1, magnet 110 is adjacent to pole 112*b* and pole 112*a*. In an embodiment, the magnet 110 is repeated throughout an array of alternating magnets and poles and within the array of alternating magnets and poles one or more magnetic undulator shims 100 are used to tune the compact hybrid permanent magnet.

Figure 5:
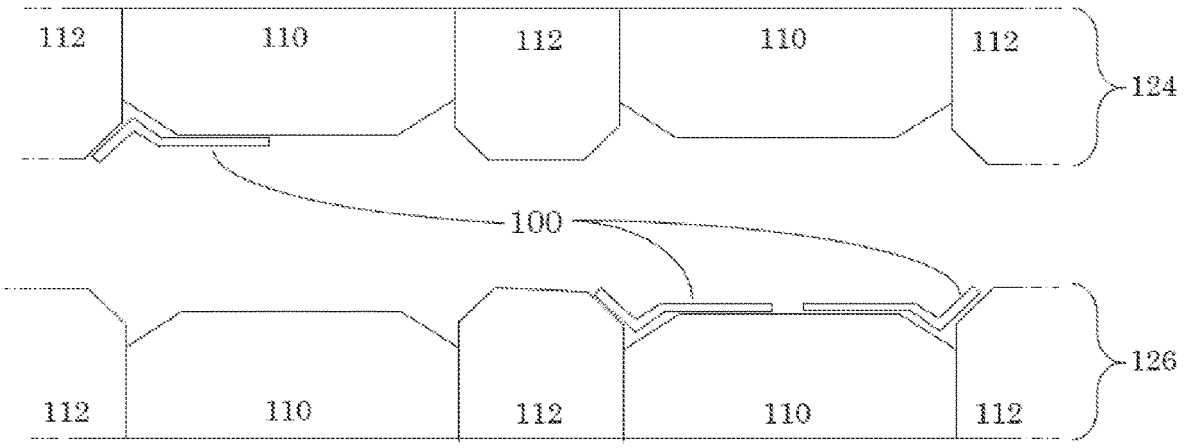
FIG. 5 illustrates a side view of multiple magnetic undulator shims within the top and bottom jaw of an undulator.

The choice of the placement of the magnetic undulator shim 100 is defined by where the magnetic field of the undulator needs to be tuned. But, in any embodiment, the magnetic undulator shim 100 is placed across both a magnet and a pole. One magnetic undulator shim 100 can be used as shown in FIG. 1, or multiple magnetic undulator shims 100 can be used. For example, FIG. 5 illustrates the use of three magnetic undulator shims 100 used within an undulator having an array of magnets 110 and poles 112. The magnets 110 and poles 112 are arranged in an alternating pattern across the top jaw 124 and bottom jaw 126. One magnetic undulator shim 100 is placed within the top jaw 124 and two magnetic undulator shims 100 are placed within the bottom jaw 126. Multiple magnetic undulator shims 100 can be used within the undulator; as many as needed to tune the device.

Returning to FIG. 1, a boundary 116 is created by the magnet 110, pole 112*a*, and the magnetic undulator shim 100. The second section 104 and the third section 106 are interconnected to form a shape of interconnection 114 that corresponds to the boundary 116. The connections between the first section 102, the second section 104, and the third section 106 may be marked by distinct angle turns but need not be. For example, the three sections can be connected in such a way as to allow the magnetic undulator shim to have the shape of an arch. The shape of interconnection 114 depends upon the boundary 116, which in FIG. 1 is created by the magnet 110 and pole 112*a*. The shape of interconnection 114 need not correspond precisely to the boundary 116, but it may. The shape of interconnection 114 must only be one that is accommodated by the boundary 116. The third section 106 is adapted to magnetically engage a surface of the pole 112*a*. In an embodiment the second section 104 is also adapted to magnetically engage the surface of the magnet 110. In an embodiment, the boundary 116 formed by the pole 112 and the magnet 110 causes the second section 104 to lay across the pole 112 or lay across both the pole 112 and the magnet 110.

Figure 2:
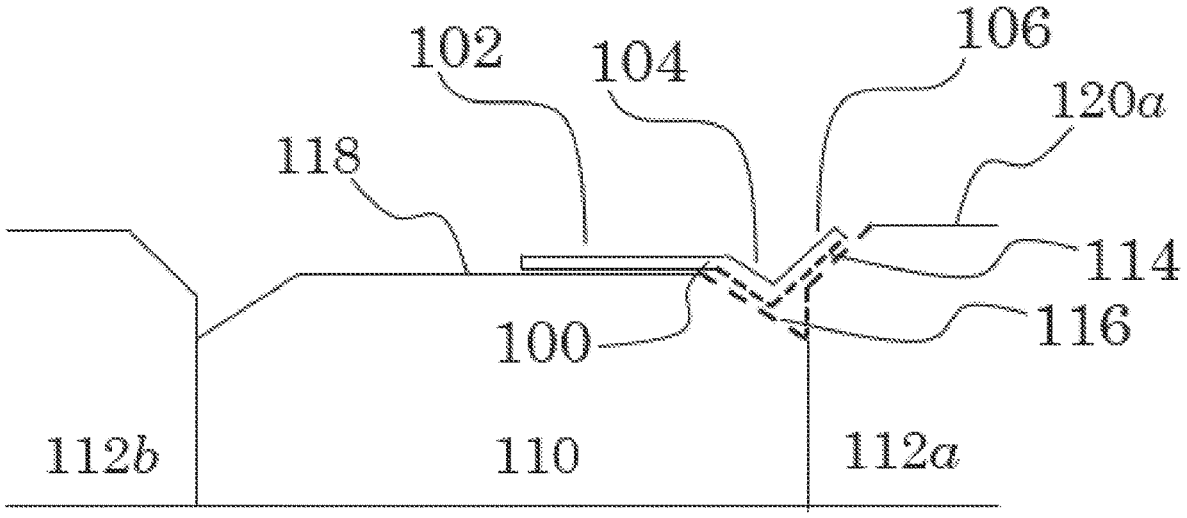
FIG. 2 illustrates a side view of a magnetic undulator shim according to an embodiment of the invention.

In accordance with the invention, the magnetic undulator shim 100 is made from any material capable of magnetically engaging the magnet 110 and the pole 112*a* and provide acceptable results of tuning the undulator. The material can be low carbon steel. The magnetic undulator shim 100 is thin enough to fit between the space between the top surface 120*a* of the pole 112*a* and the top surface 118 of the magnet 110, as seen in FIG. 2. In an embodiment, the magnetic undulator shim 100 is between approximately 100-400 microns thick.

Figure 3:
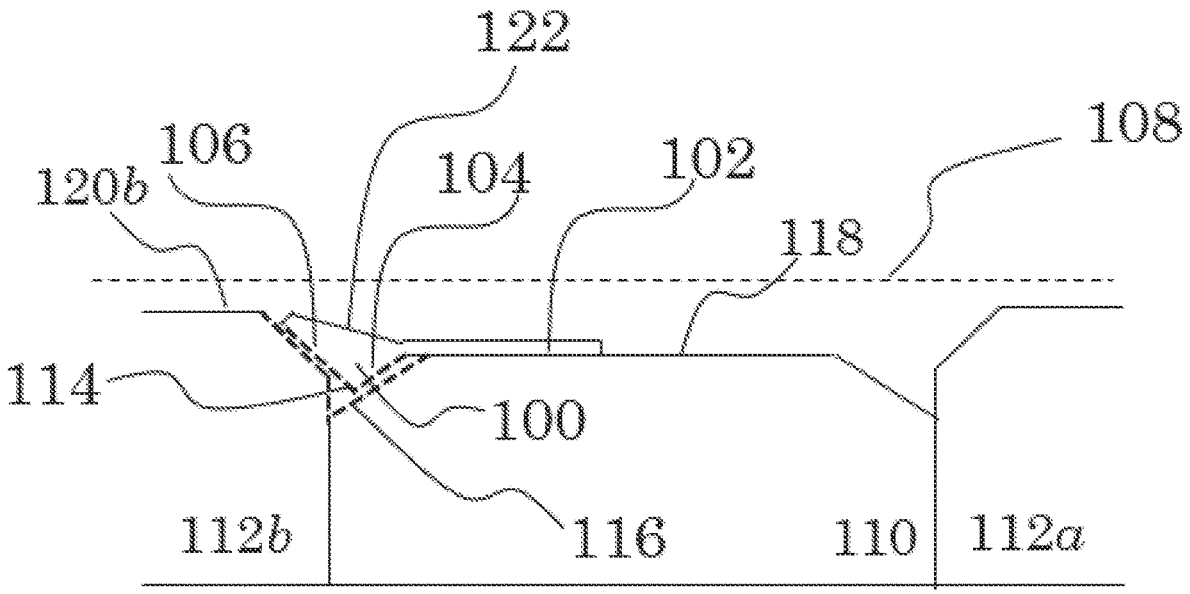
FIG. 3 illustrates a side view of a magnetic undulator shim according to an embodiment of the invention.

As shown in FIG. 3, the magnetic undulator shim 100 can vary in geometry. In this embodiment, the magnetic undulator has the same basic arrangement as in FIG. 1. The magnetic undulator shim 100 includes three interconnected sections. The first section 102, the second section 104, and the third section 106 are arranged one after the other in a direction substantially parallel to the beam axis 108. The first section 102 is adapted to magnetically engage a magnet 110 having a horizontal surface and the first section 102 is configured to extend partially onto the horizontal surface of the magnet 110. The magnet 110 is adjacent to pole 112*b* and pole 112*a*. The magnetic undulator shim 100 has a solid upper surface 122 that deviates in design from the shape of interconnection 114 and boundary 116. It is to be understood that though the terminology here is used to mainly refer to a shim placed on the lower jaw of an undulator, the terminology applies to shims placed on the upper jaw of an undulator. Altering the geometry of the magnetic undulator shim 100 can vary the strength of the tuning done to the magnetic field. However, the magnetic undulator shim 100 will still have a shape of interconnection 114 that corresponds to the boundary 116.

Figure 4:
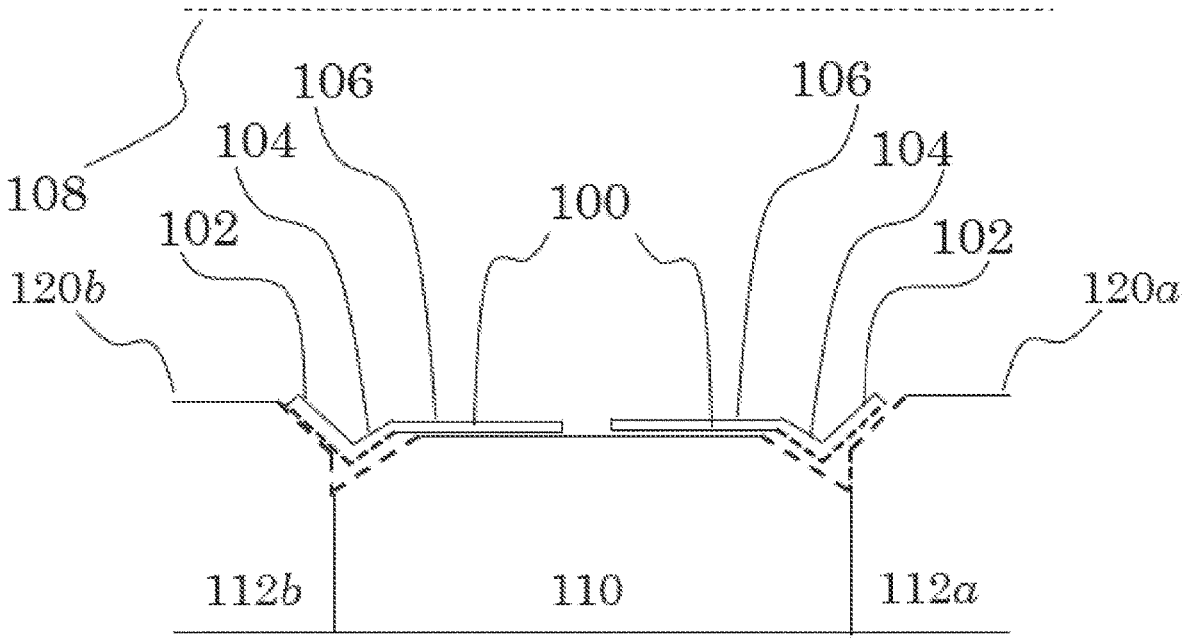
FIG. 4 illustrates a side view of two magnetic undulator shims according to an embodiment of the invention.

Referring to FIG. 4, the magnetic undulator has the same basic arrangement as in FIG. 1 except in FIG. 4 there are two magnetic undulator shims 100, each having the same basic geometry. Each magnetic undulator shim 100 has three interconnected sections arranged one after the other in a direction substantially parallel to the beam axis 108: a first section 102, a second section 104, and a third section 106. The first section 102 is adapted to magnetically engage a magnet 110 having a horizontal surface and the first section 102 is configured to extend partially onto the horizontal surface of the magnet 110. The magnet 110 is adjacent to pole 112*b* and pole 112*a*. The first section 102 of each is configured to extend partially onto the horizontal surface of the magnet 110. The first section 102 extends to less than approximately half the total length of the magnet 110 so that two magnetic undulator shims 100 may be placed onto one magnet 110. Although the three sections of magnetic undulator shim 100 remain arranged one after the other in a direction substantially parallel to the beam axis 108, the sections can be oriented in either direction from left to right, first section 102 to third section 106 or third section 106 to first section 102 depending upon where the magnetic undulator shim 100 needs to be placed.

In a simulation of the prior art shim and the present invention, it was shown that the prior art shim has a very small torque and if the shim angle mismatches the magnet chamfer, then the prior art shim will flip into the beam path at a minimum undulator gap of 8.5 mm. The simulation showed that the present invention, the magnetic undulator shim 100, has an increased torque by a factor of 10 thereby eliminating the issue of the shim being able to flip into the beam path. The present invention corrects the magnetic performance of the undulator.

The present invention is magnetically stable at even the smallest undulator gap settings, settings for which the prior art shims would be unstable and cause the shim to become displaced, or flip into the particle beam path. When the prior art shims flip into the beam path, the movement of the shim risks damaging the thin wall of the particle beam vacuum chambers. Instead, by using the present invention, the shim is magnetically stable and unable to become dislodged at even the smallest gap settings in an undulator; therefore, glue is unnecessary to keep the magnetic undulator shim 100 in place and from damaging the particle beam vacuum chambers. When the present invention is used within a traditional undulator, a cost-effective traditional undulator design and fabrication can be used. Additionally, when the present invention is used within a traditional undulator, tuning becomes more efficient and cost-effective.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

Any element in a claim that does not explicitly state "means for" performing a specified function, or "step for" performing a specific function, is not to be interpreted as a "means" or "step" clause as specified in 35 U.S.C. § 112, ¶ 6. In particular, the use of "step of" in the claims herein is not intended to invoke the provisions of 35 U.S.C. § 112, ¶ 6.

The invention claimed is:

1. A magnetic undulator shim comprising:

a) three interconnected sections arranged one after the other in a A direction substantially parallel to a beam axis;

b) the first section is adapted to magnetically engage a magnet having a horizontal surface, the first section is configured to extend partially onto the horizontal surface of the magnet, the magnet is adjacent to a pole, the magnet and the pole form a boundary between the magnet and the pole;

c) the second section and the third sections are interconnected to form a shape, the shape corresponds to the boundary; and d) the third section is adapted to magnetically engage a surface of the pole.

2. The magnetic undulator shim of claim 1, wherein the shim is a magnetic material.

3. The magnetic undulator shim of claim 1, wherein the shim is made from low carbon steel.

4. The magnetic undulator shim of claim 1, wherein the thickness of the shim is approximately 100-400 microns.

5. The magnetic undulator shim of claim 1, wherein the second section is adapted to magnetically engage the magnet.

6. The magnetic undulator shim of claim 1, wherein the third section is adapted to magnetically engage the magnet.

7. The magnetic undulator shim of claim 1 wherein the shim corrects the magnetic performance of the undulator.

8. The magnetic undulator shim of claim 1 wherein the shim affects a charged particle beam that travels in a path along the beam axis.

9. The magnetic undulator shim of claim 1 used on the upper or lower jaw of the undulator.

10. The magnetic undulator shim of claim 1 wherein a solid upper body is formed by the geometry of the first, second, and third section.

* * * * *